US006009295A

United States Patent [19]

Kimura et al.

[11] Patent Number: 6,009,295

[45] Date of Patent: Dec. 28, 1999

[54] DEVELOPING APPARATUS

[75] Inventors: Takahiko Kimura; Jun Yamaguchi, both of Ikoma; Yasuyuki Ishiguro, Higashiosaka; Yoshiaki Sanada, Ikoma; Fumito Mizoguchi, Yamatokoriyama; Takao Hiroyasu, Nara, all of Japan

[73] Assignee: Sharp Kabushiki Kaisha, Osaka, Japan

[21] Appl. No.: 09/100,947

[22] Filed: Jun. 22, 1998

[30] Foreign Application Priority Data

Jun. 26, 1997 [JP] Japan ..... 9-169875

[51] Int. Cl.[6] ..... G03G 15/08

[52] U.S. Cl. ..... 399/257; 399/252

[58] Field of Search ..... 399/257, 267, 399/253, 273, 277, 270, 271, 264, 98, 99, 100, 343, 35, 120, 222

[56] References Cited

U.S. PATENT DOCUMENTS 5,250,749 10/1993 Aimoto ..... 399/257
5,752,138 5/1998 Wing et al. ..... 399/264
5,790,920 8/1998 Teramura et al. ..... 399/71

FOREIGN PATENT DOCUMENTS 5-313497 11/1993 Japan .
211660B2 3/1998 Japan .

*Primary Examiner*—Richard Moses
*Assistant Examiner*—Hoang Ngo

[57] ABSTRACT

Impurities contained in a developer are captured and prevented from mixing into the developer again, thereby to avoid lowering of image quality due to the impurities. Such impurities include aggregates of the developer formed in a developing apparatus, insufficiently charged toner particles, defectively charged toner particles having an opposite polarity to a predetermined polarity, and defective carrier particles lacking in strength for being held by a developing magnet roller. A recess is provided between peaks of magnetism located in a lower portion of a developing magnet roller. The recess has an air pressure substantially equal to an air pressure (atmospheric pressure) in the developing apparatus, so that air in the developing apparatus and the recess does not flow only in one direction. Impurities contained in the developer circulating around the developing roller cannot be magnetically held in the lower half of the developing roller because of centrifugal force and gravity. Consequently, the impurities are separated and collected in the recess.

13 Claims, 3 Drawing Sheets

DEVELOPING APPARATUS

BACKGROUND OF THE INVENTION

1. Field of the Invention

The present invention relates to a developing apparatus for use with an electrophotographic machine such as a copier or a printer, for agitating and feeding a developer to develop an electrostatic latent image on a photosensitive drum.

2. Description of the Related Art

A developing apparatus for use with an electrophotographic apparatus such as a copier or a printer agitates a developer therein, applies an electric charge of a predetermined polarity to toner, and forms a developer layer on a developing magnet roller with a plurality of fixed magnets mounted therein. The developer layer is carried to an electrostatic latent image on a photosensitive drum, whereupon the toner is applied to the latent image to obtain a visible image.

In recent years, the demand for electrophotographic machines operable at higher speed and over an extended time period has led to the need to maintain the stable performance of developers. Generally, an increase in speed results in an increase in agitating speed inside the developing apparatus, which subjects a developer to increased stress and tends to form aggregates of the developer. The aggregates may adhere to the drum and impair image quality. Further, as a large amount of toner is supplied and agitated at high speed to enable a high-speed operation of the machine, defectively charged toner particles such as insufficiently charged toner particles and those having an opposite polarity to a desired polarity are transported to regions for development. Such situation results in scattering of the toner, image fogging, contamination of machine interiors and smudging of paper. With an increase in the peripheral speed of the developing magnet roller, defective carrier particles of low magnetic permeability may become separated and adhere to the photosensitive drum, thereby lowering image quality.

To date, these problems have been tackled chiefly by improving the toner/carrier compositions and manufacturing conditions. However, such an approach has been short of providing an overall solution to the problems. As a conventional technique of dealing with defectively charged toner particles, Japanese Examined Patent Publication JP-B2 11160 (1990) discloses a developing apparatus with a slit formed in a case bottom thereof, in which low-charged toner particles afloat in the developing apparatus are discharged through the slit, by using a positive pressure in the developing apparatus, to be collected in a toner collecting box.

In the above publication, as noted above, the developing apparatus has a slit formed in the case thereof, and a toner collecting box communicating with the developing apparatus through the slit. Toner particles afloat in the developing apparatus are discharged through the slit to be collected in the toner collecting box. While the publication does not describe a discharging mechanism, the discharging action requires a difference in internal air pressure between the developing apparatus and the collecting box. This conventional technique utilizes an increase in the air pressure in the slit on the developing apparatus side which is caused by revolution of erected parts of the developer formed with a lowermost pair of magnetic poles.

In Japanese Examined Patent Publication JP-B2 11160 (1990) noted above, while utilizing an increase in the air pressure in the slit on the developing apparatus side which is caused by the revolution of erected parts of the developer formed with a lowermost pair of magnetic poles, the air in the developing apparatus and a pocket flows in one direction, resulting in aggregates of the developer and defectively charged toner particles. Copies obtained include image flaws caused by the aggregates, and the machine interiors inevitably become stained with scattering toner.

SUMMARY OF THE INVENTION

The present invention has been made with a view to solving the above problems, and has for an object to provide a developing apparatus free from the problem of low image quality due to impurities included in a developer, such as aggregates of the developer formed in the developing apparatus, insufficiently charged toner particles, defectively charged toner particles having an opposite polarity to a predetermined polarity, and defective carrier particles lacking in strength for being held by a developing magnet roller.

In a first aspect of the present invention, a developing apparatus comprises a member for agitating or transporting a developer and a developing magnet roller including and a plurality of built-in, fixed magnets, for forming a magnetic brush of the developer on a surface thereof and developing an electrostatic latent image on a photosensitive drum, wherein a recess having an inner pressure nearly equal to atmospheric pressure is formed in a portion of a developing apparatus case opposed to a region between angular positions where peaks of magnetic force generated by a pair of north and south poles of the magnet exist, which is present in a lower peripheral portion of the developing magnet roller. With this construction, aggregates of a toner and a carrier, defectively charged toner particles, insufficiently charged carrier particles not magnetically or electrostatically attracted or transported to the developing magnet roller are collected into the recess to prevent mixing thereof into the developer, thereby to assure high-quality copying over a long period.

In a second aspect of the invention, the recess is formed in a center of the portion of the developing apparatus case opposed to the region, and a width of the recess in a direction of rotation of the developing magnet roller is equal to a distance between angular positions where magnet forces have half values of the peaks. Since the recess is opposed to a region where the magnetic brush for developer lies down, the aggregates, defective toner particles and defective carriers captured are prevented with increased efficiency from mixing into the developer again, and thereby high-quality copies can be provided over a long period of time.

In a third aspect of the invention, the recess is arranged to be deviated toward an upstream side of the developer from just below a center axis of the developing magnet roller. With this construction, the aggregates, defective toner particles and defective carriers separated by centrifugal force and gravity may be captured with increased efficiency, and thereby to assure high quality copying over a long period.

In a fourth aspect of the invention, the width of the recess in the direction of rotation of the developing magnet roller is wider as the recess nears longitudinal sides of the developing magnet roller. On the ends of the developing magnet roller and around bearings of the agitating portion in the developing apparatus, aggregates are easily formed. However, since with such construction the captured aggregates is effectively prevented from overflowing the recess, and thereby high-quality copies can be provided over a long period of time.

In a fifth aspect of the invention, a plurality of said recesses are formed to align in the direction of rotation of the developing magnet roller. Since the developer flows rapidly between the developing magnet roller and developing apparatus case, impurities are collected on a downstream side of the recesses. With the structure mentioned above, an increased amount of impurities may be captured, and thereby high-quality copies can be provided over a long period of time.

In a sixth aspect of the invention, an inner wall of the recess on a downstream side of the developer is inclined toward the downstream side from a straight line connecting the center axis of the developing magnet roller and an end of the downstream side of an opening of the recess. Such structure is effective to prevent impurities once captured from mixing into the developer again with air flows generated by rotation of the developing magnet roller, thereby high-quality copies can be provided over a long period of time.

In a seventh aspect of the invention, the recess has such a sectional shape that a maximum inner width of the recess is larger than a width of an opening thereof. Accordingly the impurities once captured are effectively prevented from being mixed into the developer again as entrained by air flows generated by rotation of the developing magnet roller, thereby to assure high quality copying over a long period.

In an eighth aspect of the invention, an electrode is disposed on an inner surface of the recess, and in the case where a negatively charged toner developer is used, a lower voltage is applied to the electrode than to the developing magnet roller and in the case where a positively charged toner developer is used, a higher voltage is applied to the electrode than to the developing magnet roller. Consequently, impurities falling into the recess may be captured, and at the same time, toner particles of opposite polarity detrimental to image quality may be drawn into and captured by the recess, and thereby high-quality copies can be provided over a long period of time.

In a ninth aspect of the invention, an electrode is disposed on an inner surface of the recess, and in the case where a negatively charged toner developer is used, a voltage in a sine wave or a fluctuating voltage such as a pulse wave having a lower average voltage is applied to the electrode than a voltage applied to the developing magnet roller, and in the case where a positively charged toner developer is used, a voltage in a sine wave or a fluctuating voltage such as a pulse wave having a higher average voltage is applied to the electrode than the voltage applied to the developing magnet roller. In this way, field vibrations are applied to the developer layer. Impurities falling into the recess may be captured, and at the same time, toner particles of opposite polarity detrimental to image quality may be drawn into and captured by the recess, and thereby high-quality copies can be provided over a long period of time.

In a tenth aspect of the invention, a distance from an opening plane of the recess to a surface of the developing magnet roller is made larger than a thickness of developer layer. Accordingly the impurities once captured are effectively prevented from being mixed into the developer again with air flows generated by rotation of the developing magnet roller, and thereby high-quality copies can be provided over a long period of time.

In an eleventh aspect of the invention, a distance from an end on a downstream side of the developer of an opening of the recess to a surface of the developing magnet roller is made shorter than a distance from an end on an upstream side of the developer of the opening of the recess to the surface of the developing magnet roller to such an extent that the opening of the recess is kept from contact with a developer layer formed on the developing magnet roller. This construction allows the recess to capture impurities with increased effect, and thereby high-quality copies can be provided over a long period of time.

In a twelfth aspect of the invention, a plurality of said recesses are disposed, and ends of openings of the recesses on a downstream side of the developer are closer to a surface of the developing magnet roller to such an extent that the openings are kept from contact with a developer layer formed on the developing magnet roller. This construction allows the recesses to capture impurities with increased effect, and thereby high-quality copies can be provided over a long period of time.

In a thirteenth aspect of the invention, a detachable and changeable collecting vessel is disposed. High-quality copies can be provided over an extended period of time by periodically changing the collecting vessels.

In a fourteenth aspect of the invention, an impurity transport mechanism is disposed in the recess, and a collecting box is disposed outside the developing apparatus case. High-quality copies can be provided over an extended period of time by reliably discharging the impurities captured in the recess out of the developing apparatus.

In a fifteenth aspect of the invention, the developing apparatus has a bore formed in a portion opposed to the developing apparatus case and an air suction mechanism is provided in the bore. This construction can provide high-quality copies over an extended time period by reliably capturing impurities separated from a layer of the developer.

According to the developing apparatus of the present invention, with the recess existing between the peaks of magnetism located in a lower portion of the developing magnet roller and having an air pressure substantially equal to the air pressure (atmospheric pressure) in the developing apparatus, air in the developing apparatus and the recess does not flow only in one direction unlike it does in the prior art. According to a mechanism to collect impurities such as aggregates of the developer into the recess, impurities contained in the developer circulating around the developing roller cannot be magnetically held any longer in the lower half of the developing roller because of centrifugal force and gravity, and consequently the impurities are separated and collected into the recess.

With the recess of the invention, impurities contained in the developer, such as aggregates of the developer formed in the developing apparatus, insufficiently charged toner particles, defectively charged toner particles of opposite polarity to the predetermined polarity, and defective carrier particles lacking in strength for being held by the developing magnet roller, are captured and never allowed to mix into the developer again, thereby preventing lowering of image quality due to the impurities.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
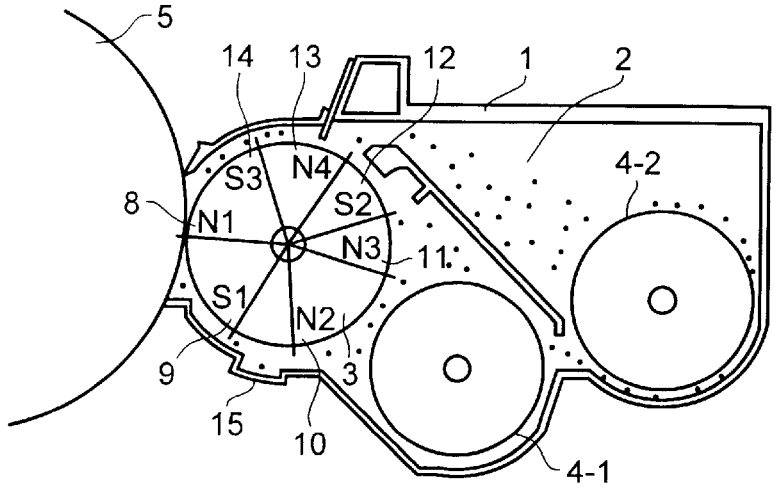
FIG. 1 is a sectional view of a developing apparatus in one embodiment of the present invention.

Now referring to the drawings, preferred embodiments of the invention are described below.

Figure 2:
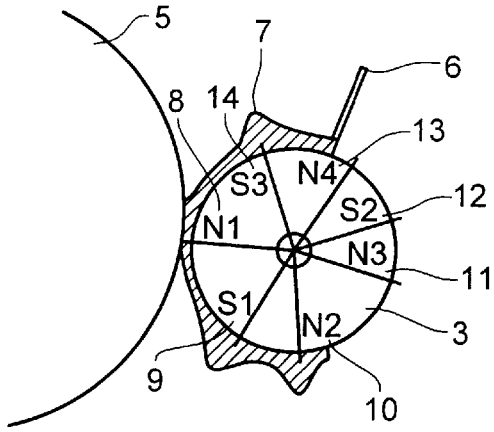
FIG. 2 is a view schematically showing a thickness of a developer layer formed on a developing magnet roller.

A developing apparatus in one embodiment of the present invention will be described hereinafter with reference to the drawings. FIG. 1 is a sectional view of the developing apparatus in one embodiment of the invention. FIG. 2 is a view schematically showing a thickness of a developer layer formed on a developing magnet roller.

Embodiment 1

An embodiment of the invention will be described with reference to FIGS. 1 and 2. FIG. 1 shows a sectional view of a developing magnet roller in a developing apparatus and a developing apparatus case 1 under the roller.

The developing apparatus of the present invention includes a developing apparatus case 1, agitating rollers 4-1 and 4-2, and a developing magnet roller 3 for agitating and transferring a developer 2. The developing magnet roller 3 has a plurality of fixed magnets 8, 9, 10, 11, 12, 13 and 14 mounted therein. A magnetic brush for developer 2 is formed on the surface of roller 3 to develop an electrostatic latent image formed on a photosensitive drum 5. A developer regulating blade 6 regulates superfluous parts of the developer 2 adhering to the developing magnet roller 3.

FIG. 2 is a view schematically showing a layer thickness of the developer 2 on the developing magnet roller 3. Numeral 7 denotes a layer of developer 2 adhering to the developing magnet roller 3.

The developer 2 moves on the surface of developing magnet roller 3 such that the developer layer becomes thick adjacent peaks of magnetism since the magnetic brush erects there, and becomes thin adjacent a middle point between the peaks of magnetism since the magnetic brush lies down there. Such movement of the developer 2 on the surface of developing magnet roller 3 is caused by a magnetic carrier in the developer 2 moving along magnetic fields on the developing magnet roller 3. Toner in the developer 2 is electrostatically held by the carrier, and transported as adhering to the carrier over the surface of the magnet roller.

With such movement of the developer 2, impurities not influenced by magnetism, aggregates of developer 2 and defective carrier particles of low magnetic permeability are separated, by gravity and centrifugal force of the developing magnet roller, from the developer 2 between peaks of magnetism located in a lower portion of the developing magnet roller 3.

Insufficiently charged toner particles are separated from the carrier because of their weak adhesion. Toner particles of opposite polarity are separated from the carrier as a result of repulsion since a voltage is applied to a sleeve for attracting toner particles charged to have a predetermined polarity.

The present invention is characterized by a recess 15 formed in a portion of the developing apparatus case 1 opposed to an angular range between peaks of magnetism provided by a pair of north pole and south pole located in a lower portion of the developing magnet roller 3, the recess 15 having an internal air pressure substantially equal to atmospheric pressure.

Specifically, the developing magnet roller 3, 60 mm in diameter, has seven magnets mounted therein: in a counter-clockwise arrangement, an N1 magnetic pole 8 of 1000 gausses opposed to the photosensitive body 5; an S1 pole 9 of 800 gausses; an N2 pole 10 of 800 gausses; an N3 pole 11 of 600 gausses; an S2 pole 12 of 500 gausses; an N4 pole 13 of 500 gausses; and an S3 pole 14 of 950 gausses.

The recess 15 is formed in a portion of the developing apparatus case 1 opposed to an angular range between peaks of magnetism provided by a pair of north pole and south pole located in a lower half of the developing magnet roller 3. The recess 15 has an opening of 12 mm and a depth of 5 mm, and extends along the developing magnet roller 3, with an internal air pressure substantially equal to atmospheric pressure.

The distance between the bottom of recess 15 and the surface of developing magnet roller 3, preferably, is at least twice the length of the magnetic brush for the developer. It is also preferred that the recess 15 located between lowermost magnetic poles for effectively collecting aggregates and defectively charged toner particles of the developer.

The above developing apparatus was applied to a copier with a copying speed of 80 per minute, and the inside of the recess was inspected after developing 100,000 copies. The recess was found to contain aggregates and defectively charged toner particles of the developer. The copies were free from image flaws due to the aggregates, and the machine interiors were not stained with scattering toner particles at all.

According to the developing apparatus of the present invention, with the recess existing between the peaks of magnetism located in a lower portion of the developing magnet roller and having an air pressure substantially equal to the air pressure (atmospheric pressure) in the developing apparatus, air in the developing apparatus and the recess does not flow only in one direction unlike it does in the prior art. According to a mechanism to collect impurities such as aggregates of the developer in the recess, impurities contained in the developer circulating around the developing roller cannot be magnetically held any longer in the lower half of the developing roller because of the centrifugal force and gravity, and consequently are separated and collected into the recess.

With the recess of the invention, impurities contained in the developer, such as aggregates of the developer formed in the developing apparatus, insufficiently charged toner particles, defectively charged toner particles of opposite polarity to the predetermined polarity, and defective carrier particles lacking in strength for being held by the developing magnet roller, are captured and never allowed to mix into the developer again, thereby preventing lowering of image quality due to the impurities.

Embodiment 2

Embodiment 2 provides the same construction as Embodiment 1.

As a different aspect, a recess is formed in a portion of the developing apparatus case 1 opposed to an angular range of 20 degrees in between peaks of magnetism provided by an S1 pole 9 and an N2 pole 10 located in a lower portion of the developing magnet roller 3 having a 60 mm diameter. The 20-degree angular range extends across a midpoint common to a 40-degree angular range from one to the other of the above poles. The recess is 5 mm deep and extends along the developing magnet roller 3.

The above developing apparatus was applied to a copier with a copying speed of 80 per minute, and the inside of the recess was inspected after developing 100,000 copies. Aggregates and defectively charged toner particles of the developer were collected with increased efficiency. The copies were free from image flaws due to the aggregates, and the machine interiors were not stained with scattering toner particles at all.

Embodiment 3

Embodiment 3 provides the same construction as Embodiment 1.

A recess is formed in a portion of the developing apparatus case 1 opposed to an angular range between peaks of magnetism provided by a pair of north pole and south pole located in the lower half of the developing magnet roller 3 having a 60 mm diameter. As a different aspect here, the recess is positioned upstream, with respect to a flowing direction of the developer 2, of a vertical line extending through the axis of the developing magnet roller 3. The recess has an opening of 12 mm and a depth of 5 mm, and extends along the developing magnet roller 3, with an internal air pressure substantially equal to atmospheric pressure.

The above developing apparatus was applied to a copier with a copying speed of 80 per minute, and the inside of the recess was inspected after developing 100,000 copies. Aggregates and defectively charged toner particles of the developer were collected with increased efficiency. The copies were free from image flaws due to the aggregates, and the machine interiors were not stained with scattering toner particles at all.

Embodiment 4

Embodiment 4 provides the same construction as Embodiment 1.

A recess is formed in a portion of the developing apparatus case 1 opposed to an angular range between peaks of magnetism provided by a pair of north pole and south pole located in the lower half of the developing magnet roller 3 having a 60 mm diameter. The recess has a depth of 5 mm and extends along the developing magnet roller 3, with an internal air pressure substantially equal to atmospheric pressure. As a different aspect here, the recess has an opening diverging from 10 mm at a middle to 15 mm at opposite ends.

The above developing apparatus was applied to a copier with a copying speed of 80 per minute, and the inside of the recess was inspected after developing 100,000 copies. Aggregates and defectively charged toner particles of the developer were collected in larger amounts toward the opposite ends of the recess. This finding appears to indicate that aggregates tend to be formed adjacent opposite ends of the developing roller and agitating rollers and around bearings in the developing apparatus.

With the construction of this embodiment, the collected aggregates never overflow the recess to mix into the developer again. The copies obtained were free from image flaws due to the aggregates, and the machine interiors were not stained with scattering toner particles at all.

Embodiment 5

Figure 3:
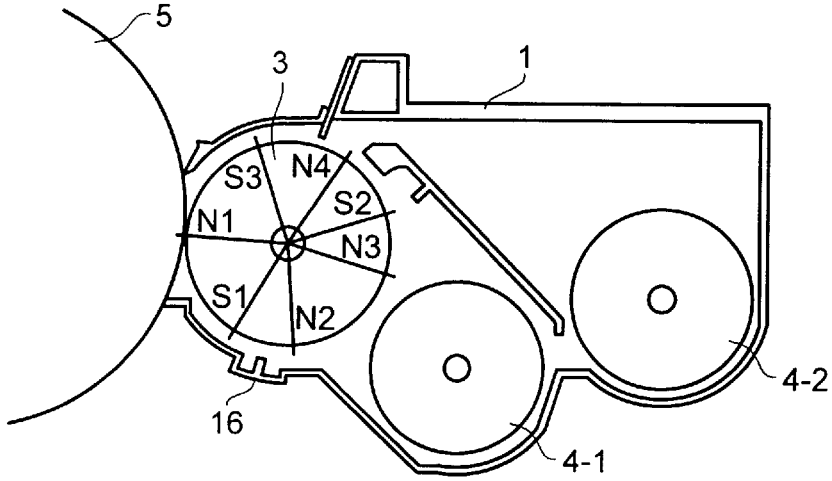
FIG. 3 is a sectional view of a developing apparatus in another embodiment of the invention.

Embodiment 5 will be described with reference to FIG. 3. This embodiment provides the same basic construction as Embodiment 1.

As a different aspect, two recesses 16 are formed in a portion of the developing apparatus case 1 opposed to an angular range between peaks of magnetism provided by a pair of north pole and south pole located in the lower half of the developing magnet roller 3 having a 60 mm diameter. The recesses 16 are partitioned by a 1 mm-thick wall, each recess 16 having an opening of 5 mm and a depth of 5 mm and extending along the developing magnet roller 3, with an internal air pressure substantially equal to atmospheric pressure.

The above developing apparatus was applied to a copier with a copying speed of 80 per minute, and the insides of the recesses 16 were inspected after developing 100,000 copies. Aggregates and defectively charged toner particles were collected in larger amounts on an inner wall of each recess downstream with respect to the flowing direction of the developer. Aggregates overflowing the upstream recess, if any, would be collected in the downstream recess. The copies were free from image flaws due to the aggregates, and the machine interiors were not stained with scattering toner particles at all.

Embodiment 6

Figure 4:
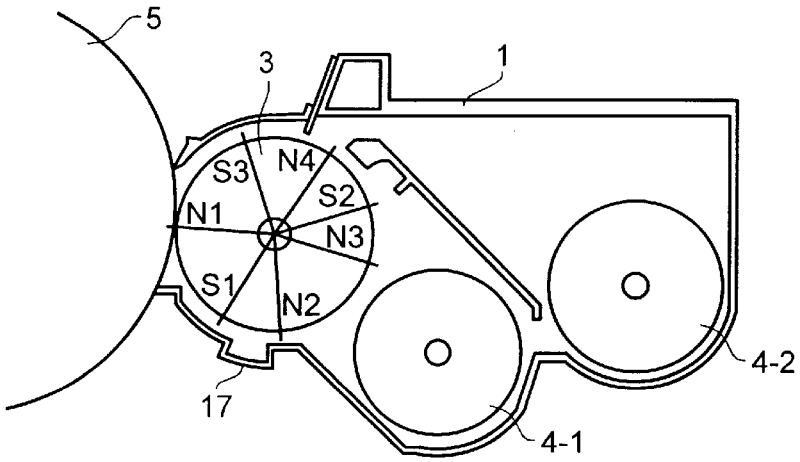
FIG. 4 is a sectional view of a developing apparatus in a further embodiment of the invention.

Embodiment 6 will be described with reference to FIG. 4. This embodiment provides the same basic construction as Embodiment 1.

A recess 17 is formed in a portion of the developing apparatus case 1 opposed to an angular range between peaks of magnetism provided by a pair of north pole and south pole located in the lower half of the developing magnet roller 3 having a 60 mm diameter. The recess 17 has an opening of 12 mm and a depth of 5 mm, and extends along the developing magnet roller 3, with an internal air pressure substantially equal to atmospheric pressure. As a different aspect here, the recess 17 has an upstream inner wall positioned in a diametrical direction of the developing magnet roller 3, and a downstream wall inclined, as it extends downward from the edge of the opening, 30 degrees downstream in a diametrical direction of the developing magnet roller 3.

The above developing apparatus was applied to a copier with a copying speed of 80 per minute, and the inside of the recess 17 was inspected after developing 100,000 copies. Aggregates and defectively charged toner particles were collected in larger amounts on the inner wall downstream with respect to the flowing direction of the developer. With the inclined downstream inner wall, the aggregates collected in the recess never mix into the developer again. The copies were free from image flaws due to the aggregates, and the machine Interiors were not stained with scattering toner particles at all.

Embodiment 7

Embodiment 7 provides the same basic construction as Embodiment 1.

A recess is formed in a portion of the developing apparatus case 1 opposed to an angular range between peaks of magnetism provided by a pair of north pole and south pole located in the lower half of the developing magnet roller 3 having a 60 mm diameter. The recess extends along the developing magnet roller 3, with an internal air pressure substantially equal to atmospheric pressure. As a different aspect here, the recess has an opening of 8 mm, and a circular section 10 mm in diameter with the center located 2 mm inward from the opening.

The above developing apparatus was applied to a copier with a copying speed of 80 per minute, and the inside of the recess was inspected after developing 100,000 copies. Aggregates and defectively charged toner particles were collected in large amounts. The aggregates collected in the recess having the above shape never mix into the developer again. The copies were free from image flaws due to the aggregates, and the machine interiors were not stained with scattering toner particles at all.

Embodiment 8

Figure 5:
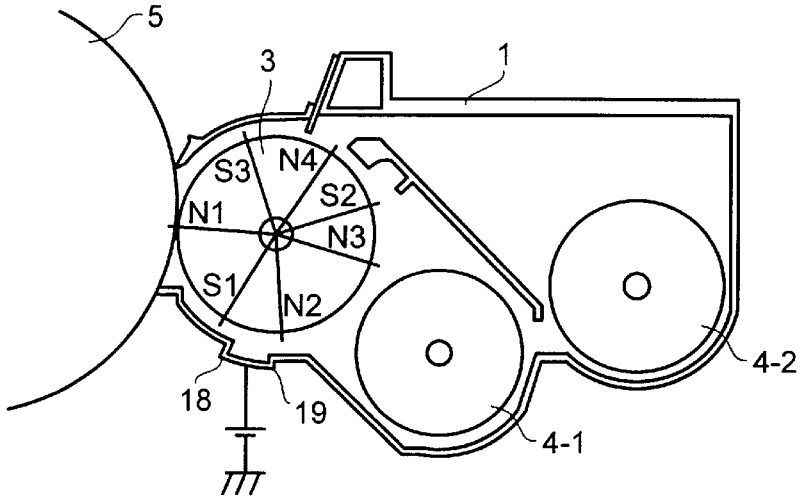
FIG. 5 is a sectional view of a developing apparatus in a still further embodiment of the invention.

Embodiment 8 will be described with reference to FIG. 5. This embodiment provides the same basic construction as Embodiment 1.

A recess 18 is formed in a portion of the developing apparatus case 1 opposed to an angular range between peaks of magnetism provided by a pair of north pole and south pole located in the lower half of the developing magnet roller 3 having a 60 mm diameter. The recess 18 has an opening of 12 mm and a depth of 5 mm, and extends along the developing magnet roller 3, with an internal air pressure substantially equal to atmospheric pressure. As a different aspect here, the recess 18 includes an electrode 19 disposed in the bottom thereof to which a voltage is applied.

The above developing apparatus was applied to a copier with a copying speed of 80 per minute, using a positively charged toner developer. The inside of the recess was inspected after developing 100,000 copies while applying −50V to the electrode in the recess, in contrast to a developing bias current of −250V. Aggregates and defectively charged toner particles (negatively charged toner particles) were collected in large amounts in the flowing direction of the developer. The copies were free from image flaws due to the aggregates, and the machine interiors were not stained with scattering toner particles at all.

In short, the developing apparatus includes the electrode 19 disposed on an inner surface of the recess 18 formed in a portion of the developing apparatus case opposed to a pair of north pole and south pole located in the lower portion of the developing magnet roller 3. When a positively charged toner developer is used, a higher voltage is applied to the electrode 19 than to the developing magnet roller 3. Similarly, where a negatively charged toner developer is used, a lower voltage is applied to the electrode 19 than to the developing magnet roller 3. Consequently, impurities falling into the recess can be captured, and at the same time, toner particles of opposite polarity detrimental to image quality may be drawn into the recess to be captured. This feature provides high-quality copies over a long period of time.

Embodiment 9

Embodiment 9 will be described with reference to FIG. 5. This embodiment provides the same basic construction as Embodiment 8.

A recess 18 is formed in a portion of the developing apparatus case 1 opposed to an angular range between peaks of magnetism provided by a pair of north pole and south pole located in the lower half of the developing magnet roller 3 having a 60 mm diameter. The recess 18 has an opening of 12 mm and a depth of 5 mm, and extends along the developing magnet roller 3, with an internal air pressure substantially equal to atmospheric pressure. The recess 18 includes an electrode 19 disposed in the bottom thereof to which a voltage is applied.

The above developing apparatus was applied to a copier with a copying speed of 80 per minute, using a positively charged toner developer. The inside of the recess 18 was inspected after developing 100,000 copies while applying a rectangular wave of two voltages, −200V and +100V, at a frequency of 200 Hz to the electrode 19 in the recess 18, in contrast to a developing bias current of −250V. Aggregates and defectively charged toner particles (negatively charged toner particles) were collected in larger amounts in the flowing direction of the developer than in the case of Embodiment 8. The copies were free from image flaws due to the aggregates, and the machine interiors were not stained with scattering toner particles at all.

In short, the developing apparatus includes an electrode 19 disposed on an inner surface of the recess 18 formed in a portion of the developing apparatus case opposed to a pair of north pole and south pole located in the lower half of the developing magnet roller 3. When a positively charged toner developer is used, a voltage in a sine wave or a fluctuating voltage such as a pulse wave having a higher average voltage is applied to the electrode 19 than the voltage applied to the developing magnet roller 3. Similarly, where a negatively charged toner developer is used, a voltage in a sine wave or a fluctuating voltage such as a pulse wave having a lower average voltage is applied to the electrode 19 than the voltage applied to the developing magnet roller 3. In this way, field vibrations are applied to the developer layer. Impurities falling into the recess may be captured, and at the same time, toner particles of opposite polarity detrimental to image quality may be drawn into and captured by the recess. This feature provides high-quality copies over a long period of time.

Embodiment 10

Embodiment 10 provides the same basic construction as Embodiment 1.

A recess is formed in a portion of the developing apparatus case 1 opposed to an angular range between peaks of magnetism provided by a pair of north pole and south pole located in the lower half of the developing magnet roller 3 having a 60 mm diameter. The recess has an opening of 12 mm and a depth of 5 mm, and extends along the developing magnet roller 3, with an internal air pressure substantially equal to atmospheric pressure. The layer of developer 2 formed on the surface of developing magnet roller 3 opposed to the recess has been found to have a maximum thickness of 1.5 mm. The distance between the opening and developing magnet roller 3 is set to 3 mm.

The above developing apparatus was applied to a copier with a copying speed of 80 per minute, and the inside of the recess was inspected after developing 100,000 copies. The recess was found to contain aggregates and defectively charged toner particles. With this construction, the aggregates and the like never mix into the developer again. The copies were free from image flaws due to the aggregates, and the machine interiors were not stained with scattering toner particles at all.

Embodiment 11

Figure 6:
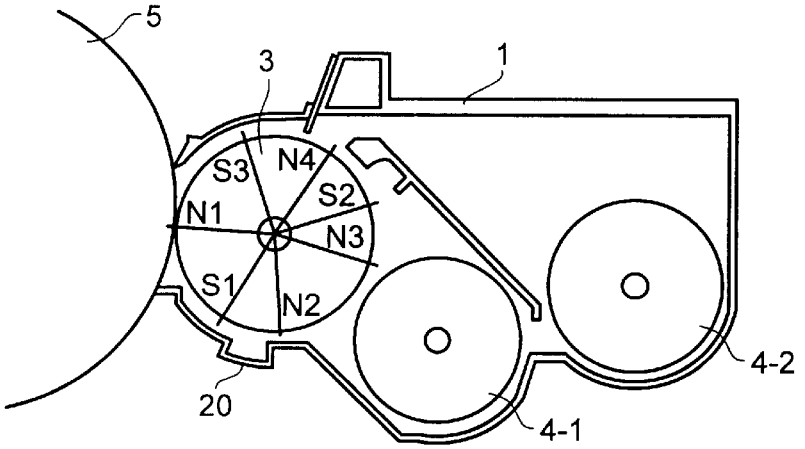
FIG. 6 is a sectional view of a developing apparatus in a still further embodiment of the invention.

Embodiment 11 will be described with reference to FIG. 6. This embodiment provides the same basic construction as Embodiment 1.

A recess 20 is formed in a portion of the developing apparatus case 1 opposed to an angular range between peaks of magnetism provided by a pair of north pole and south pole located in the lower half of the developing magnet roller 3 having a 60 mm diameter. The recess 20 has an opening of 12 mm, and extends along the developing magnet roller 3, with an internal air pressure substantially equal to atmospheric pressure. As a different aspect here, the distance between a portion of the developing apparatus case 1 on the upstream side of recess 20 and the surface of developing magnet roller 3 is set to 6 mm, the distance between the bottom of recess 20 and the surface of developing magnet roller 3 to 10 mm, and the distance between a portion of the developing apparatus case 1 on the downstream side of recess 20 and the surface of developing magnet roller 3 to 3 mm.

The above developing apparatus was applied to a copier with a copying speed of 80 per minute, and the inside of the recess 20 was inspected after developing 100,000 copies. Aggregates and defectively charged toner particles were collected in large amounts on the inner wall downstream with respect to the flowing direction of the developer.

With the raised downstream inner wall of recess 20, the aggregates collected in the recess 20 never mix into the developer 2 again. The copies were free from image flaws due to the aggregates, and the machine interiors were not stained with scattering toner particles at all.

Embodiment 12

Figure 7:
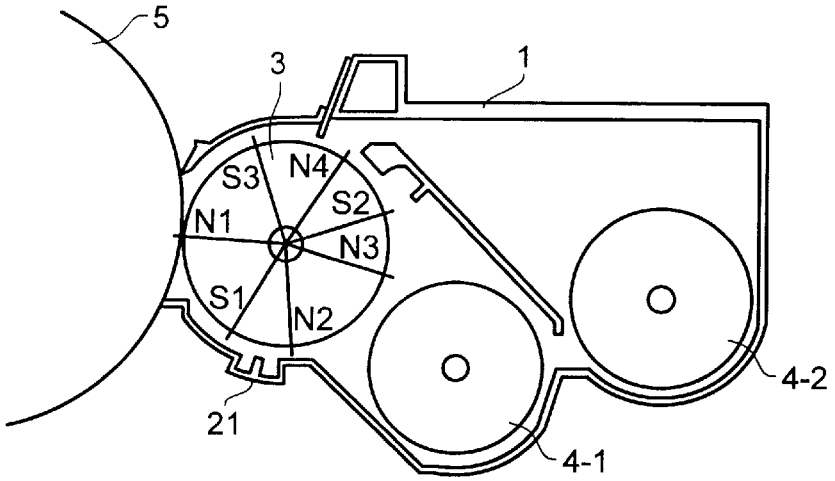
FIG. 7 is a sectional view of a developing apparatus in a still further embodiment of the invention.

Embodiment 12 will be described with reference to FIG. 7.

Two recesses 21 are formed in a portion of the developing apparatus case 1 opposed to an angular range between peaks of magnetism provided by a pair of north pole and south pole located in the lower half of the developing magnet roller 3 having a 60 mm diameter. The recesses 21 are partitioned by a 1 mm-thick wall, each recess 21 having an opening of 5 mm and extend along the developing magnet roller 3, with an internal air pressure substantially equal to atmospheric pressure. The distance between a portion of the developing apparatus case 1 on the upstream side of recesses 21 and the surface of developing magnet roller 3 is set to 6 mm, the distance between the bottoms of two recesses 21 and the surface of developing magnet roller 3 to 10 mm, the distance between the partition wall and the surface of developing magnet roller 3 to 4.5 mm, and the distance between a portion of the developing apparatus case 1 on the downstream side of recesses 21 and the surface of developing magnet roller 3 to 3 mm.

The above developing apparatus was applied to a copier with a copying speed of 80 per minute, and the inside of the recesses 21 were inspected after developing 100,000 copies. Aggregates and defectively charged toner particles were collected in larger amounts on an inner wall of each recess downstream with respect to the flowing direction of the developer. With the raised downstream inner walls of recesses 21, the aggregates collected in the recesses 20 never mix into the developer 2 again. The copies were free from image flaws due to the aggregates, and the machine interiors were not stained with scattering toner particles at all.

Embodiment 13

Embodiment 13 provides the same basic construction as Embodiment 1.

As a different aspect, a slit is formed in a portion of the developing apparatus case 1 opposed to an angular range between peaks of magnetism provided by a pair of north pole and south pole located in the lower half of the developing magnet roller 3 having a 60 mm diameter. The slit has an opening of 12 mm, and extends along the developing magnet roller 3, with an internal air pressure substantially equal to atmospheric pressure. A collecting vessel 5 mm in depth is detachably attached to the slit.

The above developing apparatus was applied to a copier with a copying speed of 80 per minute, and the inside of the collecting vessel was inspected after developing 100,000 copies. The vessel was found to contain aggregates and defectively charged toner particles of the developer. The copies were free from image flaws due to the aggregates, and the machine interiors were not stained with scattering toner particles at all. High-quality copies can be provided over a long period of time by changing or cleaning the vessel according to developer changing cycles.

Embodiment 14

Embodiment 14 provides the same basic construction as Embodiment 1.

A recess is formed in a portion of the developing apparatus case 1 opposed to an angular range between peaks of magnetism provided by a pair of north pole and south pole located in the lower half of the developing magnet roller 3 having a 60 mm diameter. The recess extends along the developing magnet roller 3, with an internal air pressure substantially equal to atmospheric pressure. As a different aspect here, the recess has an opening of 8 mm, and a circular section 10 mm in diameter with the center located 2 mm inward from the opening, and a rotatable screw of 8 mm in diameter is mounted in the recess to act as a mechanism for discharging aggregates collected in the recess. An aggregate collecting vessel is provided outside the developing apparatus.

The above developing apparatus was applied to a copier with a copying speed of 80 per minute, and the inside of the collecting vessel was inspected after developing 100,000 copies. The vessel was found to contain aggregates and defectively charged toner particles of the developer. The copies were free from image flaws due to the aggregates, and the machine interiors were not stained with scattering toner particles at all. High-quality copies can be provided over a long period of time since the aggregates collected in the recess are discharged from the developing apparatus.

Embodiment 15

Embodiment 15 will be described with reference to FIG. 8.

Figure 8:
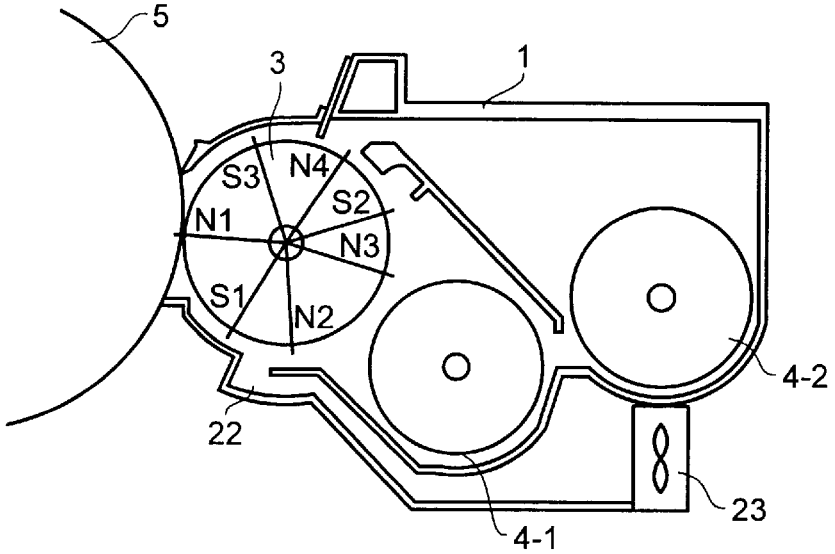
FIG. 8 is a sectional view of a developing apparatus in a still further embodiment of the invention.

FIG. 8 shows a sectional view of a developing magnet roller 3 and a developing apparatus case 1 under the roller 3 in a developing apparatus. The developing magnet roller 3, 60 mm in diameter, has seven magnets mounted therein: in a counterclockwise arrangement, a photosensitive body 5, an N1 magnetic pole 8 of 1000 gausses opposed to the photosensitive body 5; an S1 pole 9 of 800 gausses; an N2 pole 10 of 800 gausses; an N3 pole 11 of 600 gausses; an S2 pole 12 of 500 gausses; an N4 pole 13 of 500 gausses; and an S3 pole 14 of 950 gausses.

A vent 22 is formed in a portion of the developing apparatus case 1 opposed to an angular range between S1 pole 9 and N2 pole 10 located in a lower portion of the developing magnet roller 3. The vent 22 has an opening of 12 mm and a depth of 5 mm, and extends along the developing magnet roller 3, with a fan 23 acting as a suction mechanism.

The above developing apparatus was applied to a copier with a copying speed of 80 per minute, and the vent duct was inspected after developing 100,000 copies. The vent duct was found to contain aggregates and defectively charged toner particles of the developer. The copies were free from image flaws due to the aggregates, and the machine interiors were not stained with scattering toner particles at all.

The present invention is not limited to the embodiments hereinbefore described and illustrated in the drawings, and may of course be modified as appropriate without departing from the gist thereof.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a member for agitating or transporting a developer a developing magnet roller including a plurality of built-in, fixed magnets, for forming a magnetic brush of the developer on a surface thereof and developing an electrostatic latent image on a photosensitive drum, a developing apparatus case, a recess formed monolithically with the developing apparatus case, having an open top and a closed bottom surface, and the recess is formed opposed to a region between angular positions where peaks of magnetic force generated by a pair of north and south poles of the magnet exist, which is present in a lower peripheral portion of the developing magnet roller, wherein inner pressure in the developing apparatus case is substantially equal to atmospheric pressure.

2. The developing apparatus of claim 1, wherein the recess is formed in a center of the portion of the developing apparatus case opposed to the developing magnet roller.

3. The developing apparatus of claim 1, wherein the recess is arranged to be deviated toward an upstream side of the developer from just below a center axis of the developing magnet roller.

4. The developing apparatus of claim 1, wherein a plurality of said recesses are formed to align in the direction of rotation of the developing magnet roller.

5. The developing apparatus of claim 1, wherein an inner wall of the recess on a downstream side of the developer is inclined toward the downstream side from a straight line connecting the center axis of the developing magnet roller and an end of the downstream side of an opening of the recess.

6. The developing apparatus of claim 1, wherein the recess has such a sectional shape that a maximum inner width of the recess is larger than a width of an opening thereof.

7. The developing apparatus of claim 1, wherein an electrode is disposed on an inner surface of the recess, and in the case where a negatively charged toner developer is used, a lower voltage is applied to the electrode than to the developing magnet roller and in the case where a positively charged toner developer is used, a higher voltage is applied to the electrode than to the developing magnet roller.

8. The developing apparatus of claim 1, wherein an electrode is disposed on an inner surface of the recess, and in the case where a negatively charged toner developer is used, a voltage in a sine wave or a fluctuating voltage such as a pulse wave having a lower average voltage is applied to the electrode than a voltage applied to the developing magnet roller, and in the case where a positively charged toner developer is used, a voltage in a sine wave or a fluctuating voltage such as a pulse wave having a higher average voltage is applied to the electrode than the voltage applied to the developing magnet roller.

9. The developing apparatus of claim 1, wherein a distance from an opening plane of the recess to a surface of the developing magnet roller is made larger than a thickness of developer layer.

10. The developing apparatus of claim 1, wherein a distance from an end on a downstream side of the developer of an opening of the recess to a surface of the developing magnet roller is made shorter than a distance from an end on an upstream side of the developer of the opening of the recess to the surface of the developing magnet roller to such an extent that the opening of the recess is kept from contact with a developer layer formed on the developing magnet roller.

11. The developing apparatus of claim 1, wherein a plurality of said recesses are disposed, and ends of openings of the recesses on a downstream side of the developer are closer to a surface of the developing magnet roller to such an extent that the openings are kept from contact with a developer layer formed on the developing magnet roller.

12. The developing apparatus of claim 1, wherein an impurity transport mechanism is disposed in the recess, and a collecting box is disposed adjacent the developing apparatus case, the collecting box sharing a common wall with the developing apparatus case.

13. The developing apparatus of claim 1, wherein a bore is formed in a portion of the developing apparatus opposed to the developing apparatus case, in which bore an air suction mechanism is provided.

* * * * *